US006472590B1

(12) United States Patent
Kulik

(10) Patent No.: US 6,472,590 B1
(45) Date of Patent: Oct. 29, 2002

(54) ARM SHEATH FOR USE WITH A STRINGED INSTRUMENT

(76) Inventor: Roderick R. Kulik, 2535 Shenandoah Dr., Pittsburgh, PA (US) 15241-2829

( * ) Notice: Subject to any disclaimer, the term of this patent is extended or adjusted under 35 U.S.C. 154(b) by 0 days.

(21) Appl. No.: 09/854,323

(22) Filed: May 11, 2001

(51) Int. Cl.[7] ..... G10G 7/00

(52) U.S. Cl. ..... 84/453; 84/322; 84/329; 2/59; 2/16

(58) Field of Search ..... 84/453, 329, 322; 2/16, 59; D2/860; D29/120.1

(56) References Cited

U.S. PATENT DOCUMENTS 2,459,992 A 1/1949 Cimino
4,135,431 A * 1/1979 Ferguson ..... 84/329
4,856,112 A * 8/1989 Effle ..... 2/59
4,974,762 A 12/1990 Boretsky et al.
4,982,641 A 1/1991 Duhart
5,187,813 A 2/1993 Klein
5,755,355 A 5/1998 Mazzo

* cited by examiner

*Primary Examiner*—Shih-Yung Hsieh
(74) *Attorney, Agent, or Firm*—Gene Scott-Patent Law & Venture Group

(57) ABSTRACT

A combination apparatus is used with a stringed instrument. It comprises a tapered cylindrical tube, open at both ends thereof, and adapted in length to extend from a wrist area of a user to below an elbow of the user. The ends of the tube each provides an elastic cuff adapted for biased expansion so as to grip an arm of a musician inserted into the cylindrical tube. The tube further provides a pocket mounted on an exterior surface and one or more string picks engaged within the pocket.

5 Claims, 4 Drawing Sheets

ARM SHEATH FOR USE WITH A STRINGED INSTRUMENT

BACKGROUND OF THE INVENTION

1. Field of the Invention

This invention relates generally to protective wearing apparel and more particularly to an combination arm sheath and string pick adapted for beneficial use with a guitar or other stringed instrument.

2. Description of Related Art

The following art defines the present state of this field:

Cimino, U.S. Pat. No. 2,459,992 describes a sleevelet-purse for the forearm comprising a sleevelet with one end larger than the other, said sleevelet being proportioned along its length to fit the forearm and provided with a plurality of pockets in said sleevelet for keys, coins, cosmetics and the like, the larger end of said sleevelet being a closed band, the smaller end of said sleevelet being longitudinally split over substantially its entire length, means for first fastening together the split portions of said sleevelet at the smaller end thereof, and means for thereafter fastening together the split portions of said sleevelet along the length thereof and thereby closing the opening therebetween, whereby the sleevelet-purse may be passed over the hand when both fastening means are not engaged, secured at the wrist when the first fastening means are engaged, and finally secured on the forearm with the split opening closed when the last-mentioned fastening means are engaged.

Boretsky et al., U.S. Pat. No. 4,974,762 describes a dispenser for liquid refreshment that is removably carried in a pocket attached to an armband. The armband is adapted to be worn on an upper arm of a person engaged in a continuous physical activity such as running. The dispenser, a flask of oval cross section has an upper closure and filler cap including a squirting spout. While being engaged in the activity such as running, the wearer of the armband and pocket may remove the flask from the pocket and use all or a portion of the liquid by squirting the liquid into an opened mouth. The pocket includes a shorter, rectangular outer wall and a longer rectangular inner wall which is disposed adjacent and is attached to the armband in a central portion of its adjacent major surface. The outward facing surface of the inner wall serves as a guide surface to reinsert the flask into the pocket. The inner wall is of a length substantially equal to the length of the flask. Thus, when the flask is inserted into the pocket, the inner wall is a protective interface between the runner's arm and the flask. The oval cross-sectional shape of the flask shapes the edges of the pocket to cause such edges to become spaced from the arm of the person wearing the armband. The spacing is sufficient to prevent abrasive contact as a result of relative movement between the edges of the pocket and the arm of the wearer.

Duhart, U.S. Pat. No. 4,982,641 describes a guitar pick holder including a band removeably fitted around the arm of a guitar player generally at the wrist. A tether line having a first end and a second end opposite the first end is connected to the band at its first end and extends generally downwardly from the band. The length of the tether line extending down from the band substantially corresponds to the distance from the wrist to the fingertips of the guitar player. A guitar pick is connected to the second end of the tether line.

Klein, U.S. Pat. No. 5,187,813 describes a combination napkin and sleeve or forearm protector comprising an absorbent and flexible disposable paper sheet rectangular in shape when laid out flat and being press-pleated on one side to form a trapezoidal shaped sheet or napkin having press pleats on the narrow side to be worn as a lower arm or sleeve protector. The napkin/protector has adhesive tab or hook and loop type fasteners at the corners adjacent the narrow side. When worn on a wrist by a wearer the napkin is conical in shape flaring upward toward the wearers elbow with the fasteners at the wearers wrist so as to provide coverage protection from exposure to any undesirable element to the forearm or clothing of the wearer. The napkin may be constructed of heavier materials or reusable cloth material as desired with additional fasteners on the sides of the protector to attach the protector to the arm of the wearer up to the elbow. When not worn by a wearer the napkin/sleeve protector can be used as a napkin.

Mazzo, U.S. Pat. No. 5,755,366 describes a waterproof wallet and pouch combination that can be securely worn around the wrist, with the wallet secured in the pouch in a substantially waterproof manner. The pouch is secured to the limb by means of a sleeve and is secured in position by hook and loop type fasteners. When the back of the pouch seals over the opening in the pouch to secure to the front of the pouch by hook and loop type fasteners the section of the front of the pouch adjacent the opening of the pouch folds back on its self. The wallet contains a note compartment which runs the length of the wallet, and is divided into three sections along its length and is folded with, at least, one of the end sections being folded onto the middle section, and placed in the pouch.

The prior art teaches the use of stockings and sheaths used on an arm when playing a musical instrument, but does not teach a sheath having the constructional features and benefits of the instant invention.

SUMMARY OF THE INVENTION

The present invention teaches certain benefits in construction and use which give rise to the objectives described below.

A combination apparatus is used with a stringed instrument. It comprises a tapered cylindrical tube, open at both ends thereof, and adapted in length to extend from a wrist area of a user to below an elbow of the user. The ends of the tube each provides an elastic cuff adapted for biased expansion so as to grip an arm of a musician inserted into the cylindrical tube. The tube further provides a pocket mounted on an exterior surface and one or more string picks engaged within the pocket.

A primary objective of the present invention is to provide an apparatus and method of use of such apparatus that provides advantages not taught by the prior art.

Another objective is to provide such an invention capable of preventing wear of a musical instrument.

A further objective is to provide such an invention capable of preventing skin oils and sweat from contacting the surface of a musical instrument.

A still further objective is to provide such an invention capable of storing and dispensing string picks in a manner that is at once convenient, sure and Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
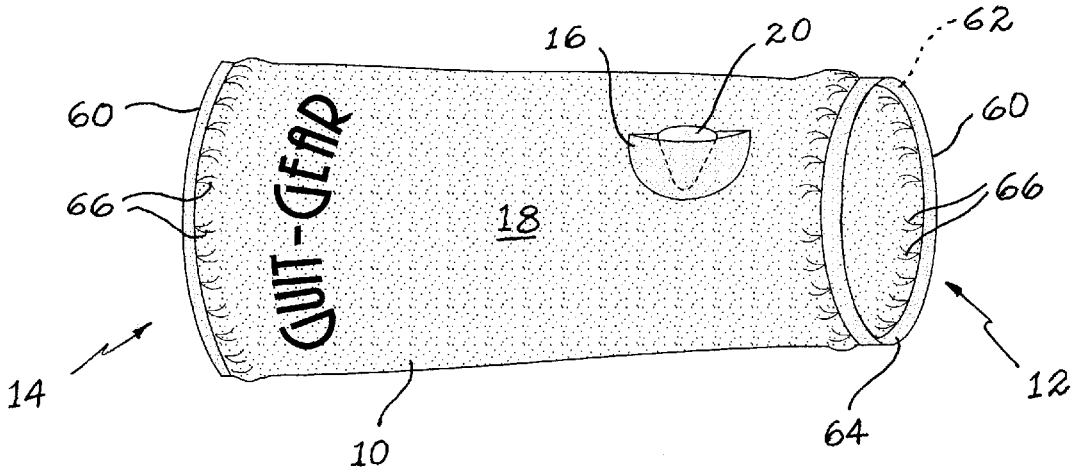
FIG. 1 is a front side elevation view of the preferred embodiment of the invention.
Figure 2:
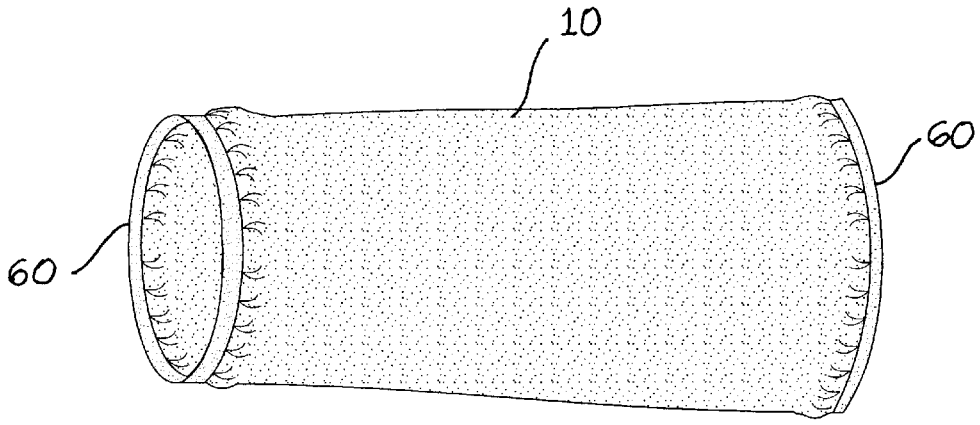
FIG. 2 is a rear side elevation view thereof.
Figure 3:
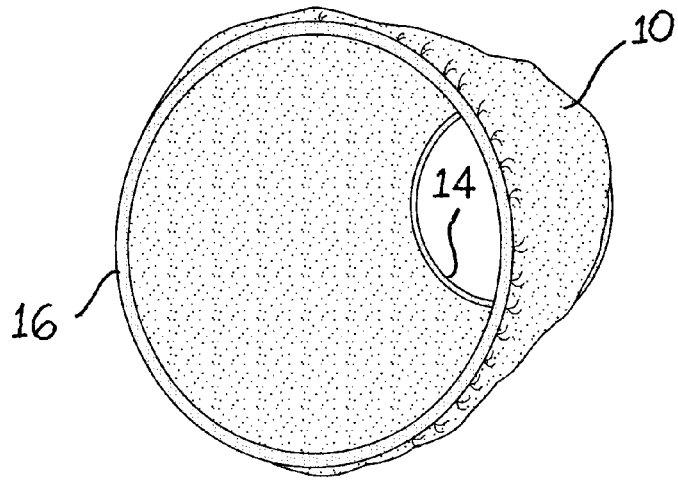
FIGS. 3 and 4 are perspective end views thereof.
Figure 4:
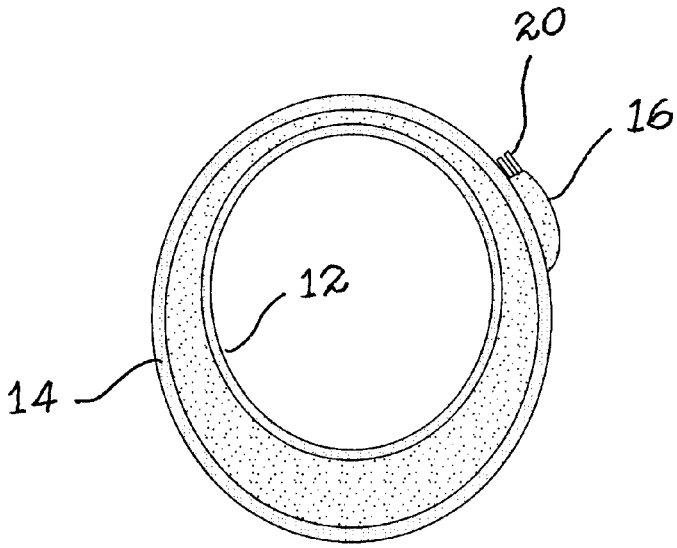
Figure 6:
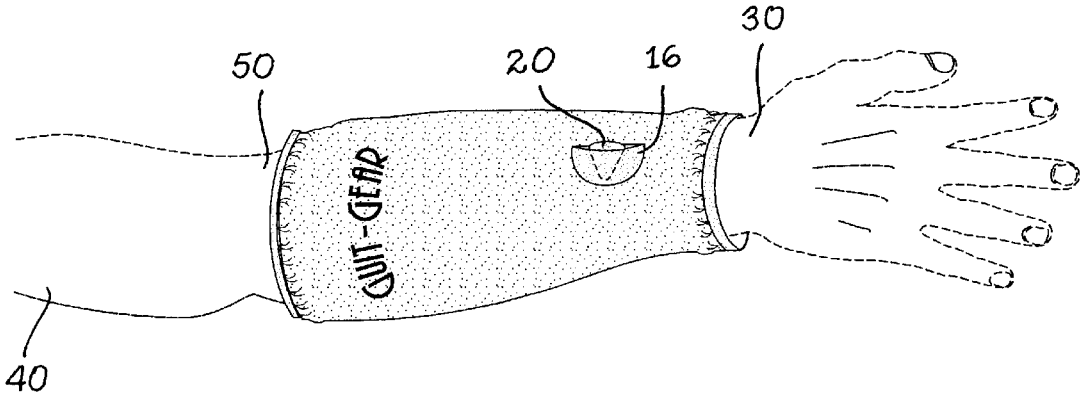
FIG. 6 is a front side elevation view thereof, as shown with an arm inserted.
Figure 7:
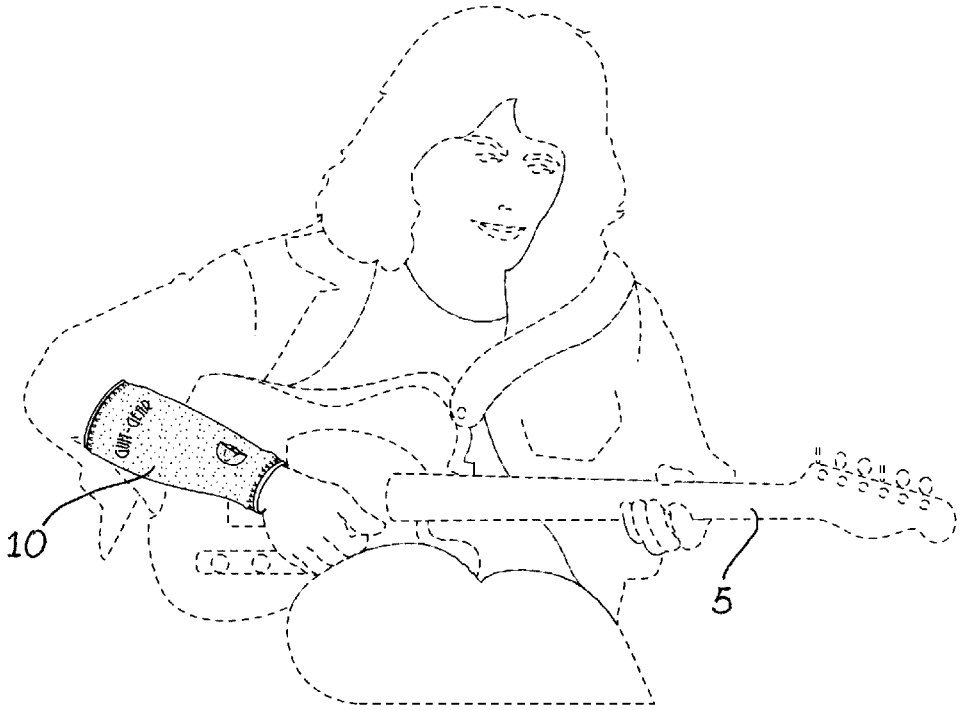
FIG. 7 is a perspective view thereof in use.

A combination apparatus is used with a stringed instrument 5 (not part of the invention) as shown in FIG. 7. The apparatus comprises the combination of an arm sheath 10 with string picks 20 within a pocket 16, as shown in FIG. 1. The sheath 10 is a flexible tapered cylindrical tube made preferably of cloth or fabric and open at both of its ends 12, 14. It is adapted by its length to extend from a wrist area 30 of a user's arm 40, to an area 50 below an elbow of the user's arm 40. This is clearly shown in FIG. 6. Both of the ends 12, 14 provide an elastic cuff 60 adapted in diameter and resilience for biased expansion so as to grip the user's arm 40 when the arm 40 is inserted into the cylindrical tube. This provides the advantage of holding the tube in place; preventing it from wrinkling or moving on the user's arm 40 when in use. Each of the elastic cuffs 60 preferably comprise an elastic band 62 held within a peripheral circular hem 64. The cloth adjacent to the cuff 60 is gathered, (gathers 66), as is clearly shown, so as to enable the cuffs 60 to expand elastically depending upon the arm size. Alternately, the cloth itself may be of an elastic material such as Lycra® or Spandex® two well known and widely used fabrics.

Figure 5:
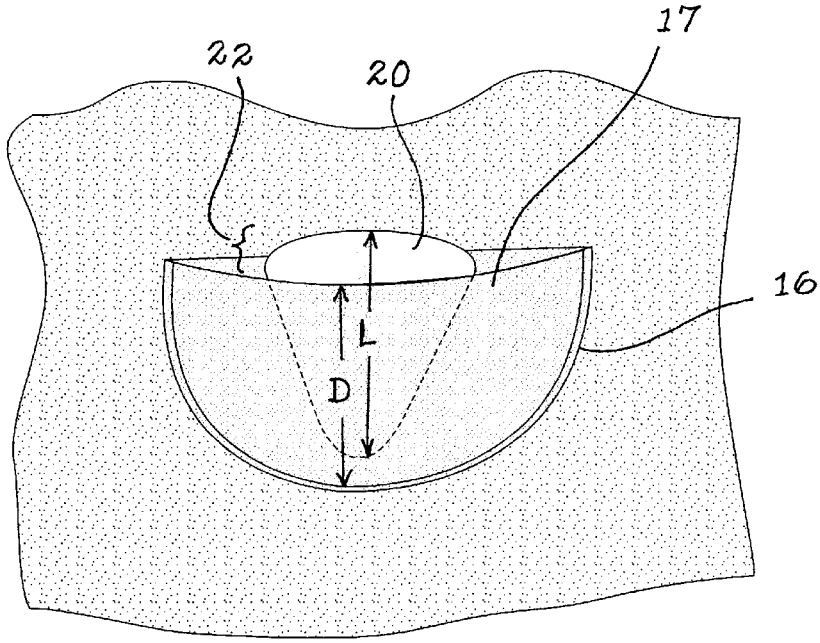
FIG. 5 is close-up view of a pocket thereof.

The tube further provides the pocket 16 mounted on an exterior surface 18 of the tube. At least one of the string picks 20, and preferably plural picks 20 are removeably engaged by insertion within the pocket 16 and held therein by compression of the sidewall 17 of the pocket. Preferably, the pocket 16 has a depth "D" of less than the length "L" of the pick 20 such that a portion 22 of the pick 20 protrudes from the pocket 16 when the pick 20 is fully inserted into the pocket 16, as is best seen in FIG. 5.

Preferably, the cylindrical tube is made of a material impermeable to liquids such as a microwoven fabric. In this case liquids will not easily pass through the fabric but the fabric will still 'breath;' i.e., enable the passage of an air flow. Alternately, the cylindrical tube may be made of a fabric material treated for impermeability to liquids, such as by impregnating the fabric with a plastic or wax substance as is well known in the prior art.

In use, the invention is worn by a musician, as shown in FIG. 7, so that the sheath 10 comes into contact with the musical instrument 5 rather then the skin surface of the arm 40. In this manner it is possible to avoid discoloration of the musical instrument from the oils and sweat of the musician when the sheath 10 is made of a moisture impermeable material or one treated to be so impermeable. The availability of string picks 20 from the pocket 16 provides a great convenience to the musician and a place to store the pick when the musician is finished performing. More than once, a musician may be unable to perform or to continue when his/her pick is misplaced. The use of a shallow pocket 16 that holds the pick by compression of the pocket's sidewall 17 has been found to provide improved utility in swift and sure storage and retrieval of the pick 20 which may need to be picked up many times during a performance. The use of the apparatus enables the development of a habit in pick storage so that the musician is confident in always having a pick 20 handy.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination apparatus for use with a stringed instrument which comprises: a tapered cylindrical tube, open at both ends thereof, and adapted in length to extend from a wrist area, to below an elbow of an arm of a user, wherein each of the ends provides an elastic cuff adapted for biased expansion so as to grip the arm, the tube further providing an open pocket mounted on an exterior surface thereof; and at least one string pick removeably engaged within the pocket; the pocket positioned adjacent the wrist area and oriented to open upwardly when the arm is oriented approximately horizontally, thereby enabling a pick to be withdrawn quickly from the pocket when needed during a performance.

2. The apparatus of claim 1 wherein the elastic cuff comprises an elastic band positioned within a peripheral circular hem.

3. The apparatus of claim 2 wherein the pocket has a depth of less than the length of said pick such that a portion of said pick protrudes from the pocket when said pick is fully inserted into the pocket.

4. The apparatus of claim 1 wherein the cylindrical tube is made of a material impermeable to liquids.

5. The apparatus of claim 1 wherein the cylindrical tube is made of a stretchable fabric material treated for impermeability to skin oils and sweat.

* * * * *